US005894398A

United States Patent [19]

Harris et al.

[11] Patent Number: 5,894,398

[45] Date of Patent: Apr. 13, 1999

[54] SOLENOID OPERATED REMOTE RESETTING DEVICE WITH A PROTECTIVE ACTIVATION CIRCUIT

[75] Inventors: Matthew R. Harris, Raleigh; Gregory R. Lawrence, Wilson; Timothy B. Phillips, Raleigh, all of N.C.

[73] Assignee: Square D Company, Palatine, Ill.

[21] Appl. No.: 08/962,075

[22] Filed: Oct. 31, 1997

Related U.S. Application Data

[62] Division of application No. 08/424,770, Apr. 18, 1995.

[51] Int. Cl.[6] ..... H01H 47/32

[52] U.S. Cl. ..... 361/160; 307/140

[58] Field of Search ..... 361/152–154, 361/160, 170, 194, 195; 307/140, 132 EA

[56] References Cited

U.S. PATENT DOCUMENTS

| | | | |
|---|---|---|---|
| 3,215,864 | 11/1965 | Doyle et al. | 327/393 |
| 3,577,040 | 5/1971 | Campbell | 361/154 |
| 4,449,161 | 5/1984 | Kling | 361/152 |
| 4,500,938 | 2/1985 | Dulin | 361/153 |
| 4,642,726 | 2/1987 | Matsko et al. | 361/195 |
| 5,486,972 | 1/1996 | Taylor | 361/154 |
| 5,719,738 | 2/1998 | Singer et al. | 361/154 |

FOREIGN PATENT DOCUMENTS

| | | | |
|---|---|---|---|
| 2 133 941 | 8/1984 | United Kingdom | 361/195 |

*Primary Examiner*—Fritz Fleming

*Attorney, Agent, or Firm*—Larry I. Golden; David R. Stacey; Larry T. Shrout

[57] ABSTRACT

A solenoid operated remote resetting device with a protective solenoid activation circuit is disclosed. The solenoid activation circuit includes circuitry for protecting the solenoid from overheating due to intentional or unintentional prolonged current flow in the solenoid. The solenoid activation circuit receives an activation signal, in the form of an alternating current signal, from a remote activation means. The activation signal is coupled to a rectifier in the solenoid activation circuit that provides rectified DC power for the solenoid activation circuit. A solenoid power circuit is also coupled to the rectifier input such that the AC signal from the activation means can be rectified and passed to the solenoid positive DC signal. A timing circuit coupled between the rectifier output and the solenoid power circuit provides an active phase of a predetermined time and a blocking phase after each application of the activation signal. The solenoid power circuit provides power to the solenoid only during the active phase. The blocking phase prevents any continuing signal from the activating means from reaching the solenoid after the active phase has been completed. Termination of the activation signal resets the active phase for the next application of the activation signal.

10 Claims, 10 Drawing Sheets

SOLENOID OPERATED REMOTE RESETTING DEVICE WITH A PROTECTIVE ACTIVATION CIRCUIT

This application is a divisional of Application Ser. No. 08/424,770 filed on Apr. 18, 1995.

Devices operated by solenoids and specifically to circuits for protecting the solenoid from overheating during operation.

It is known to use a solenoid for providing a mechanical operation in response to an electrical signal. Generally the electrical signal is initiated from a location remote to the device being operated by the solenoid. It is also known to initiate the electrical signal by pressing an operator interface device, such as a push button, for a period of time required to cause the desired response. This time period is usually only a fraction of a second. However, the reaction time of most people will be somewhat longer thereby causing current to be applied to the solenoid for a period of time longer than required to produce the desired response. The problem can also occur if the operator interface sticks in the closed position or is held in the closed position for a prolonged period of time thus causing current to be continuously supplied to the solenoid circuit. In other applications, the solenoid can be controlled by a programmable logic controller ("PLC") device which is programmed to initiate operation of the solenoid in response to a predetermined logical condition. If, for any reason, the PLC device should cause a continuous current to flow in the solenoid circuit or should the PLC repeatedly attempt to initiate the solenoid operation, a heat failure of the solenoid would occur. When there are no size constraints on the solenoid, a larger solenoid capable of handling the extended current flow can be used. Small solenoids used in today's solid state devices are more susceptible to heating failures and therefore are at a higher risk of solenoid failure due to heating when current is applied to the solenoid activating circuit for an extended period of time. However, modern solid state devices generally require a small solenoid and further require that the heat dissipated by the solenoid be less than a level that will cause damage to any of the solid state components which are in close proximity to the solenoid. It is therefore desirable to provide a solid state solenoid activation circuit which will provide protection to the solenoid against heat caused failure due to extended current in the solenoid circuit and rapid repeated activation of the solenoid. It is also desirable that this circuit have few components such that it can be assembled on a small printed circuit board and be relatively inexpensive to manufacture.

If the desired operation is not performed in the expected time frame the operator will probably press the button again and again. These repeated operations cause heat to build in the solenoid and can ultimately cause failure of the solenoid.

SUMMARY OF THE INVENTION

It is an object of the present invention to provide a simple solenoid activation circuit of few components which can be easily assembled on a small printed circuit board. It is also an object of the present invention to provide protection against solenoid failure due to heat caused by extended current flow in the solenoid circuit and rapid repeated operation of the solenoid. This protection circuit permits the use of a smaller solenoid which would normally be more susceptible to heat damage. These objects are accomplished by including a timer circuit in the solenoid activation circuit, which, after a time sufficient for the solenoid to perform its intended function, prevents further current from being applied to the solenoid as long as power continues to be applied to the solenoid activation circuit. When power is removed from the solenoid activation circuit the circuit will be automatically reset for the next solenoid operation initiated by the operator interface device or PLC device.

Other features and advantages of the invention will become apparent to those skilled in the art upon review of the following detailed description, claims and drawings.

Figure 1:
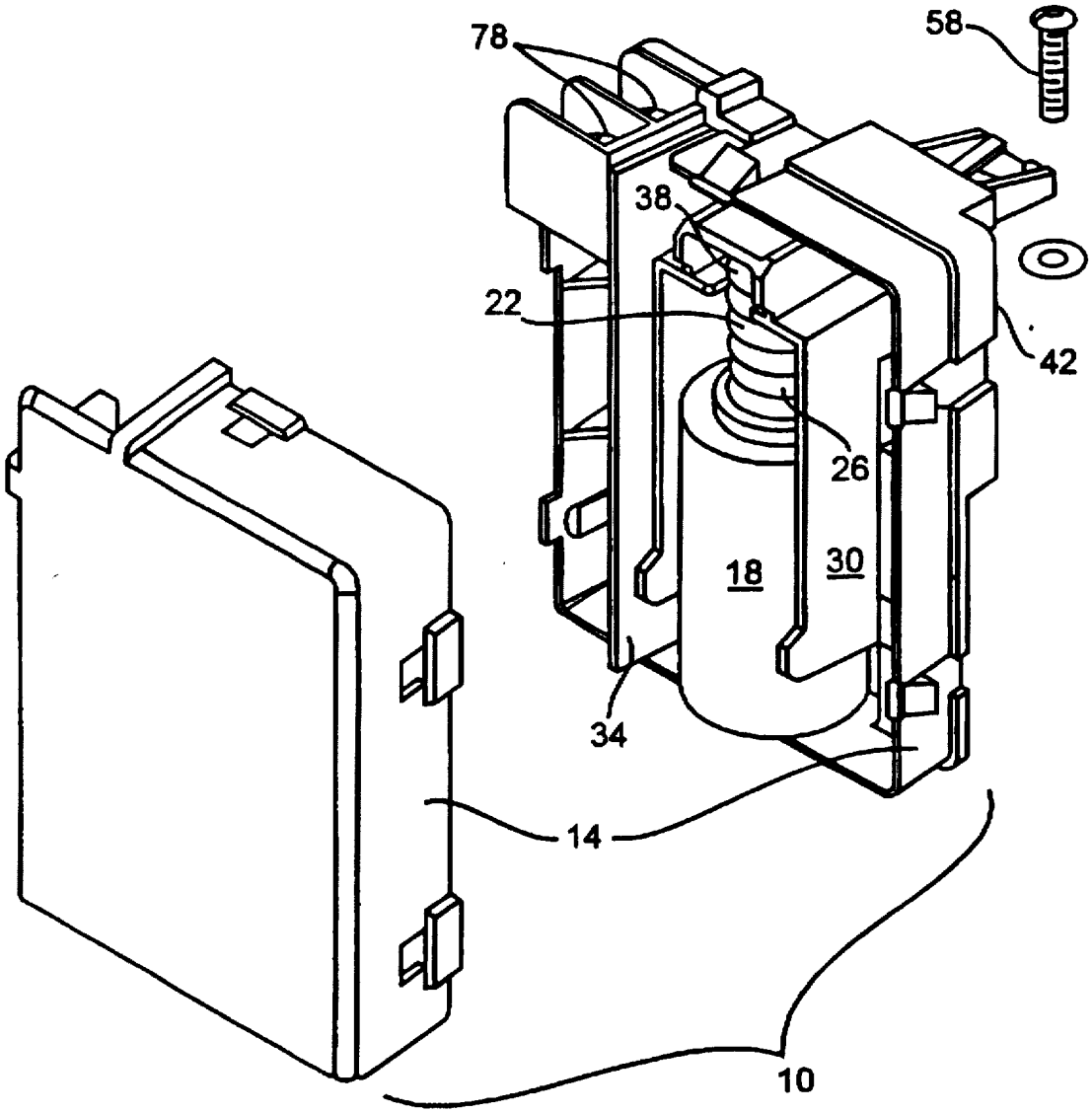
FIG. 1 is an exploded view of a solenoid operated remote mechanical operator device in accordance with the present invention.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 2:
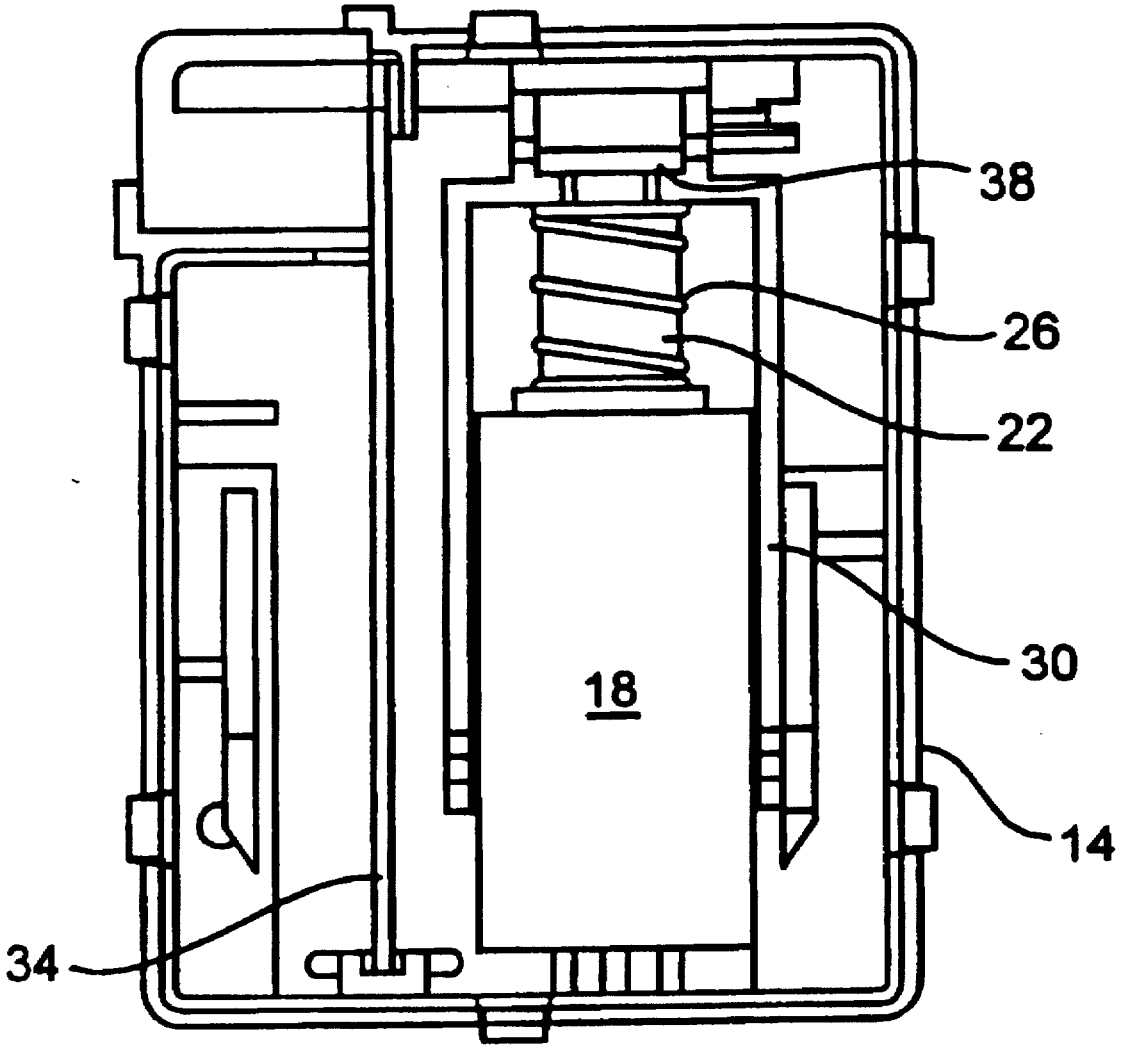
FIG. 2 is a front interior view of a solenoid operated remote mechanical operator in accordance with the present invention.

A solenoid operated remote resetting device 10 in accordance with the present invention is generally illustrated FIG. 1. The remote resetting device 10 includes a housing 14 made from two parts which snap together to define a hollow interior. Enclosed within the housing are a solenoid 18, a solenoid plunger 22, a plunger return spring 26, a mechanical operator 30, and a printed circuit board 34. As shown in FIG. 2, the solenoid 18 and printed circuit board 34 are fixedly held by portions of the housing 14 such that movement is prohibited. The solenoid plunger 22 is normally biased to a first position as shown in FIG. 2 by the return spring 26 and is linearly movable to a second position as shown in FIG. 5 when current is applied to the solenoid 18. Also movably enclosed within the housing 14 is the mechanical operator 30 which is attached to an extending end 38 of the plunger 26 such that the mechanical operator 30 is also movable between a first position shown in FIG. 4 and a second position shown in FIG. 5.

Figure 3:
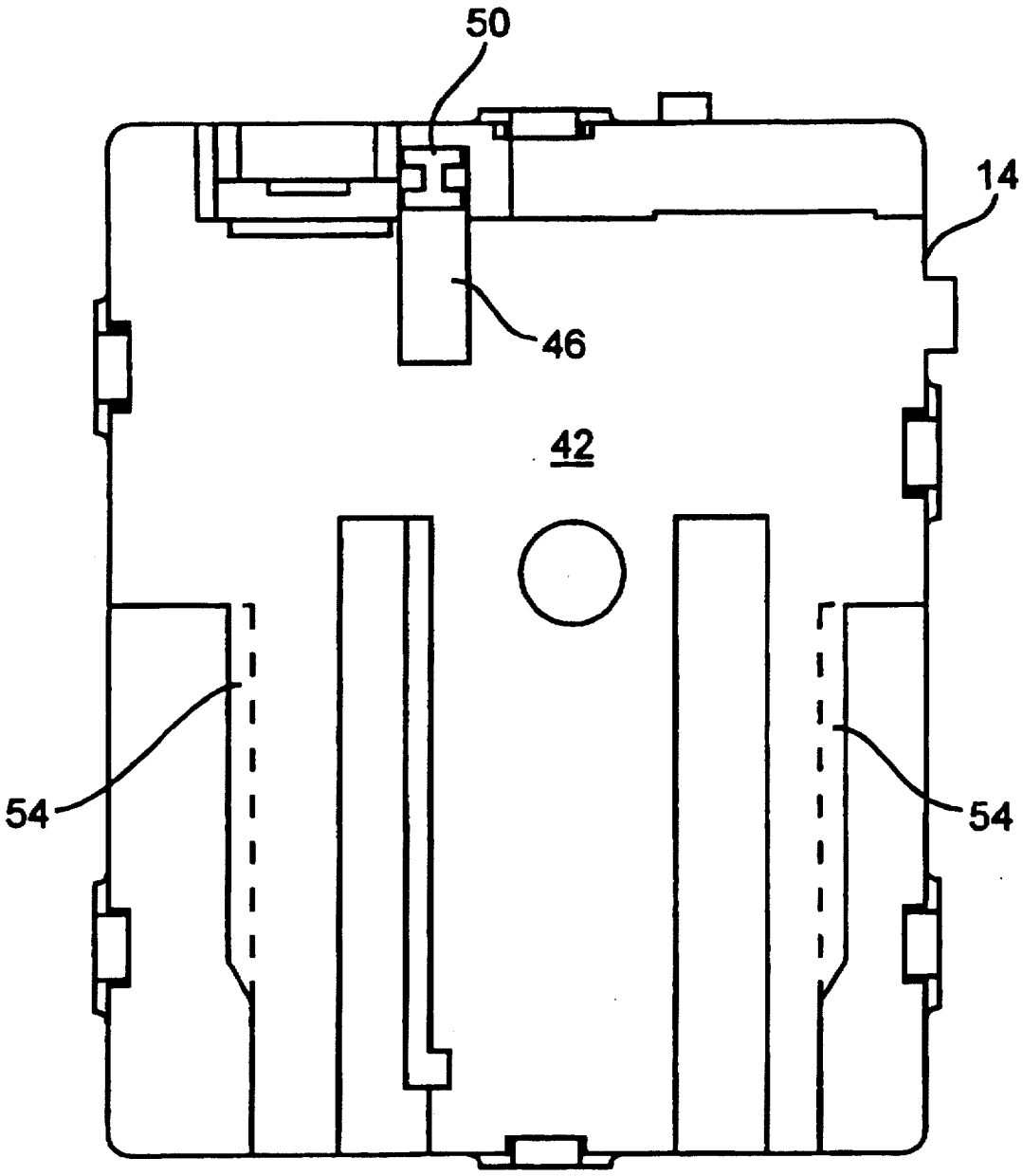
FIG. 3 is a view of the back of a solenoid operated remote mechanical operator in accordance with the present invention.

Referring now to FIG. 3, an operating side of the housing 14, generally indicated by reference numeral 42 is juxtaposed to the device being operated by the solenoid operated remote resetting device 10. A rectangular opening 46 is defined by the housing 14 such that it passes through the operating side 42. The opening 46 receives an operating arm 50 which extends outwardly through the opening 46. The operating arm 50 is an integral part of the mechanical operator 30 and therefore also moves linearly between a first position and a second position. This linear movement corresponds to the movement of the plunger 22 between its first and second positions. Also defined on the operating side 42 of the housing 14 are two generally parallel spaced apart retaining ribs 54. These ribs 54 are slidingly received in two correspondingly spaced apart generally parallel grooves provided in the enclosure of the device to be operated by the solenoid operated remote resetting device 10. The ribs 54 and corresponding grooves provide a means for properly aligning the solenoid operated remote resetting device 10 with the device being operated. A fastener, such as a screw 58 shown in FIG. 1, is used to secure the solenoid operated remote resetting device 10 to the enclosure of the device being operated.

Figure 4:
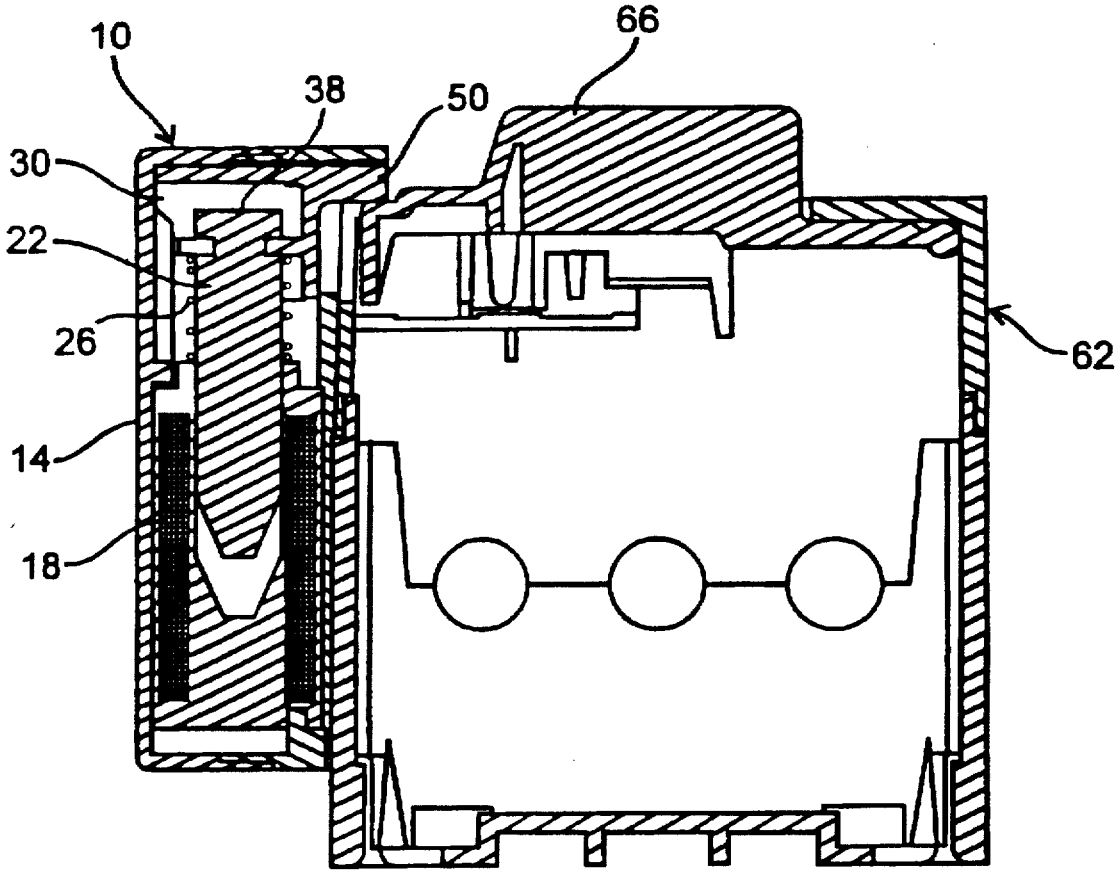
FIG. 4 is a sectionalized view of a solenoid operated remote mechanical operator device showing the solenoid in its normal operating position with respect to a device which it is to operate when activated.
Figure 5:
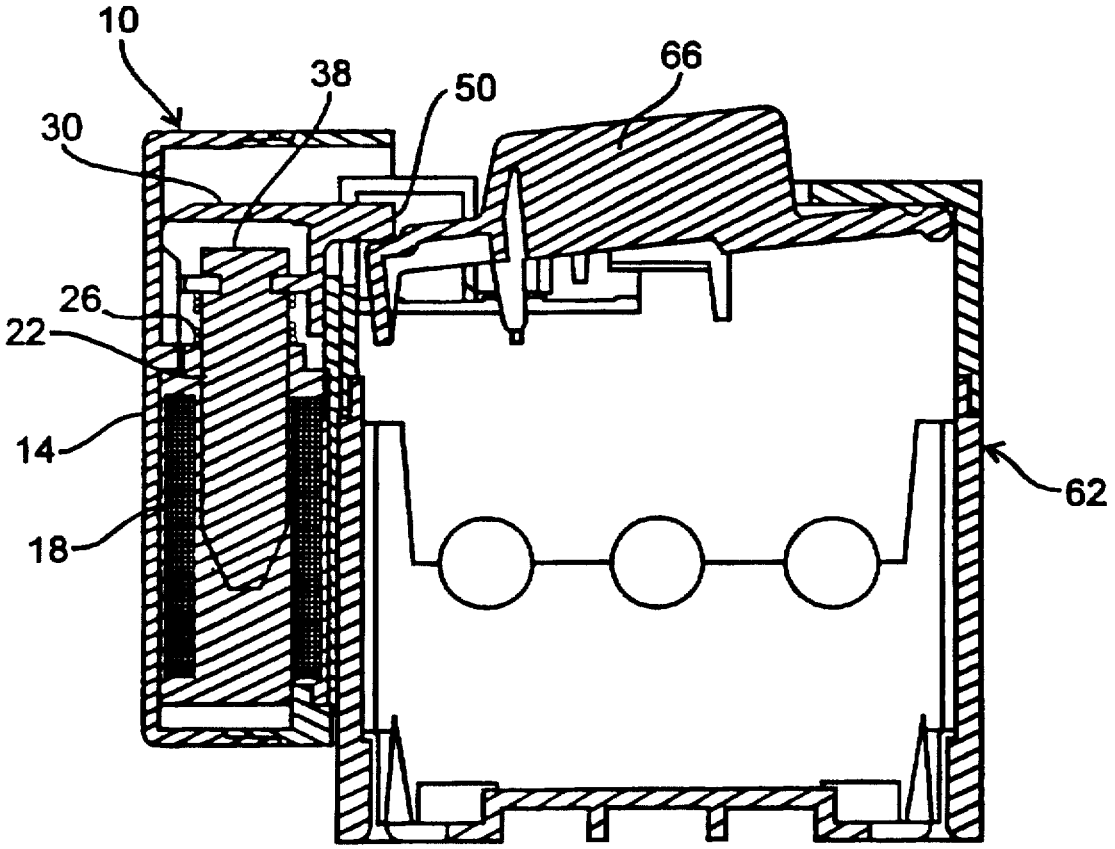
FIG. 5 is a sectionalized view of a solenoid operated remote mechanical operator device showing the solenoid in its activated position with respect to a device which it is to operate when activated.

Referring now to FIGS. 4 and 5 a solenoid operated remote resetting device 10 of the present invention is attached to the housing of an overload protection device generally indicated by reference numeral 62. In FIG. 4 the solenoid plunger 22 is shown in its normally biased first position wherein the operating arm 50 is located immediately adjacent to a manual reset mechanism 66 of the overload protection device 62. In FIG. 5, current has been applied to the solenoid 18 causing the solenoid plunger 22, mechanical operator 30 and operating arm 50 to be moved to their second position. In moving to the second position the operating arm 50 engages the manual reset mechanism 66 causing it to be moved to a reset position and thereby resets the tripped overload protection device 62.

Figure 6:
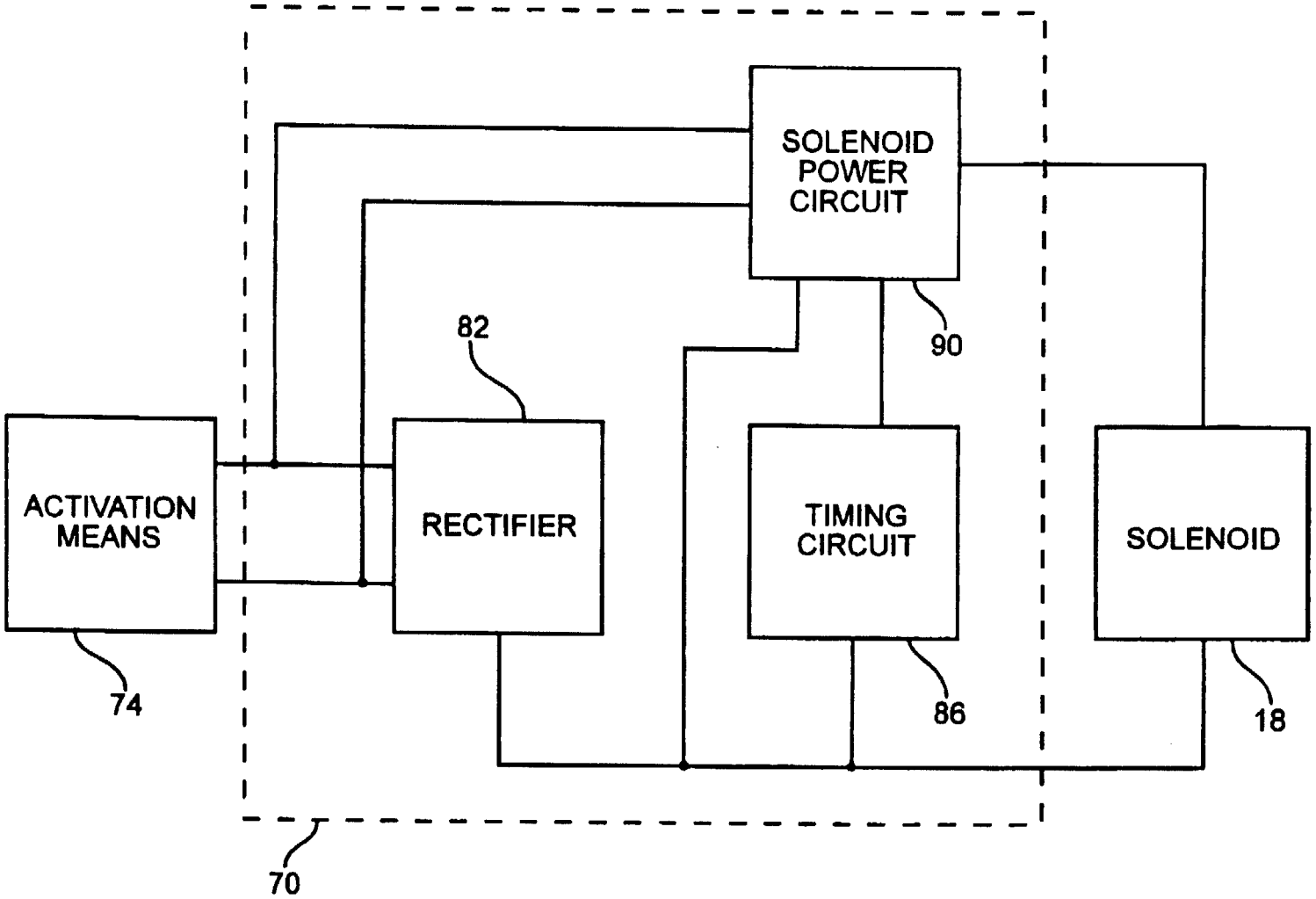
FIG. 6 is a block diagram of a first embodiment of a solenoid activation circuit in accordance with the present invention.

Referring now to FIG. 6, a block diagram of a solenoid activation circuit, generally indicated by reference numeral 70, is shown. Also shown in FIG. 6 is an activation means 74 which includes devices such as a manually operated operator interface device, programmable logic controller or other interposing relays which provide an AC (alternating current) electrical activation signal to the solenoid operated remote resetting device 10. The electrical activation signal is received through a pair of terminals 78 mounted on the housing 14 as shown in FIG. 1. The terminals 78 are electrically connected to the printed circuit board 34. This electrical activation signal provides operating power to a solenoid activation circuit 70. The solenoid activation circuit 70 includes a rectifier 82, a timing circuit 86 and a solenoid power circuit 90.

Figure 7:
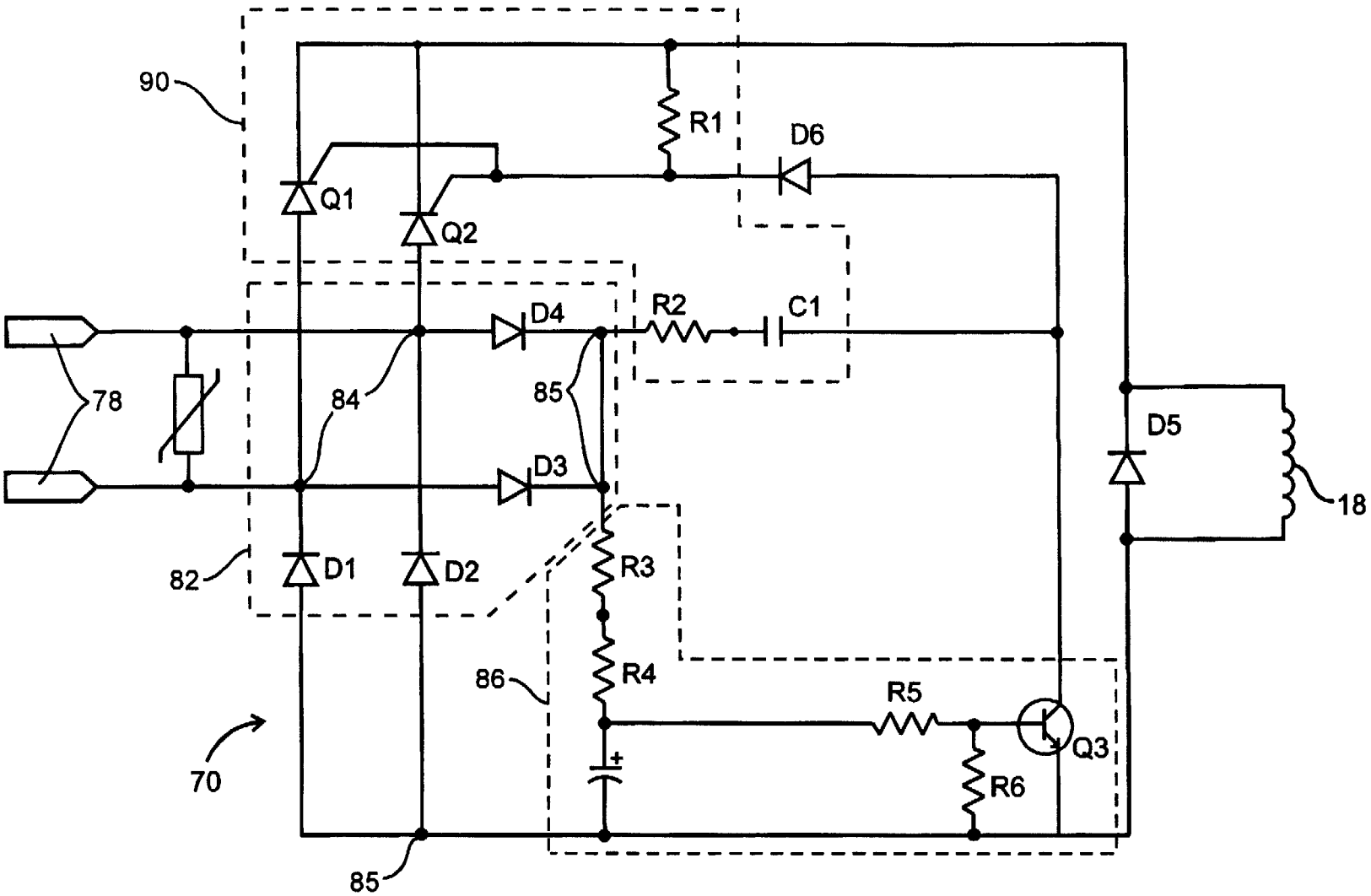
FIG. 7 is a circuit diagram of the first embodiment of a solenoid activation circuit in accordance with the present invention.

Referring now to FIG. 7, a first embodiment of the solenoid activation circuit 70 will be explained. In this embodiment, a full wave bridge rectifier 82 includes diodes D1, D2, D3 and D4. The AC electrical activation signal is passed to rectifier 82 at a pair of input terminals 84 connected to the anodes of diodes D3 and D4. A pair of output terminals 84 located at the anodes of diodes D1 and D2 and cathodes of diodes D3 and D4 provide DC current for the timing circuit 86. The solenoid power circuit 90 is composed of resistors R1 and R2, capacitor Cl and silicon controlled rectifiers Q1 and Q2. The anodes of SCR's (silicon controlled rectifiers) Q1 and Q2 are electrically connected to the input terminals 84 of the rectifier 82. The resistor R2, capacitor C1 and diode D6 are electrically connected to the output terminals 85 of the rectifier 82 and provide gate current for SCR's Q1 and Q2 which in turn controls current flow through Q1 and Q2. The timing circuit 86 is composed of resistors R3, R4, R5 and R6, capacitor C2 and transistor Q3 and is also electrically connected to the output terminals 85 of the rectifier 82. When an AC electrical activation signal from the activation means 74 is received at the input 84 of the rectifier 82, a DC current begins to flow from the output terminals of the rectifier 82. If a positive half cycle is starting at the anode of D4, the voltage will be increasing with respect to the voltage at the anode of D3. As soon as the voltage is greater than the sum of the residual voltage on C1, the forward-bias voltages of D4 and D6 and the gate-bias voltage of Q2, current will begin to flow through D4, R2 and C1. At this time Q3 in the timer circuit is in a high impedance state which causes the current to flow through D6 thereby gating Q2 into conduction until the end of the half cycle and thereby activating the solenoid 18. As the positive half cycle ends at the anode of D4, current will continue to flow through Q2 until the freewheeling current of the solenoid 18 and freewheeling diode D5 has dropped to zero. During the succeeding negative half cycle, voltage at the anode of D3 will be increasing with respect to the voltage at the anode of D4. As soon as the voltage is greater than the sum of the residual voltage on C1, the forward-bias voltages of D3 and D6 and the gate-bias voltage of Q1, current will begin to flow through D3, R2 and C1. If Q3 in the timer circuit is in at a high impedance state current begin to flow through D6 thereby gating Q1 into conduction until the end of the half cycle and thereby activating the solenoid 18. Power will continue to be supplied to the solenoid 18 in this manner until the blocking phase is initiated by the timer circuit 86. During this same time interval, current is also flowing in the timer circuit 86. As the charge on C2 increases, the voltage at the base of transistor Q3 increases until Q3 is biased "ON". When Q3 is "ON" it is in a low impedance state and begins to conduct. When Q3 is in full conduction the gate voltage of Q1 and Q2, is not sufficient to turn them on, thus current flow to the solenoid 18 is stopped Q3 will remain in conduction as long as an AC electrical signal is received from the activation means 74. The component values chosen for the timing circuit 86 will determine the length of time for an active phase in which the solenoid is activated. A blocking phase in which the solenoid is not activated starts as soon as Q3 is in full conduction and continues until the AC electrical activation signal from the activation means 74 is discontinued. After the blocking phase is discontinued, R6 allows the voltage at the base of Q3 to bleed off, thereby resetting the active phase time for the next AC electrical activation signal from the activation means 74. Thus, as soon as the AC electrical activation signal from the activation means 74 is discontinued, the solenoid activation circuit 70 is immediately ready to receive and process the next AC electrical signal from the activation means 74.

Figure 8:
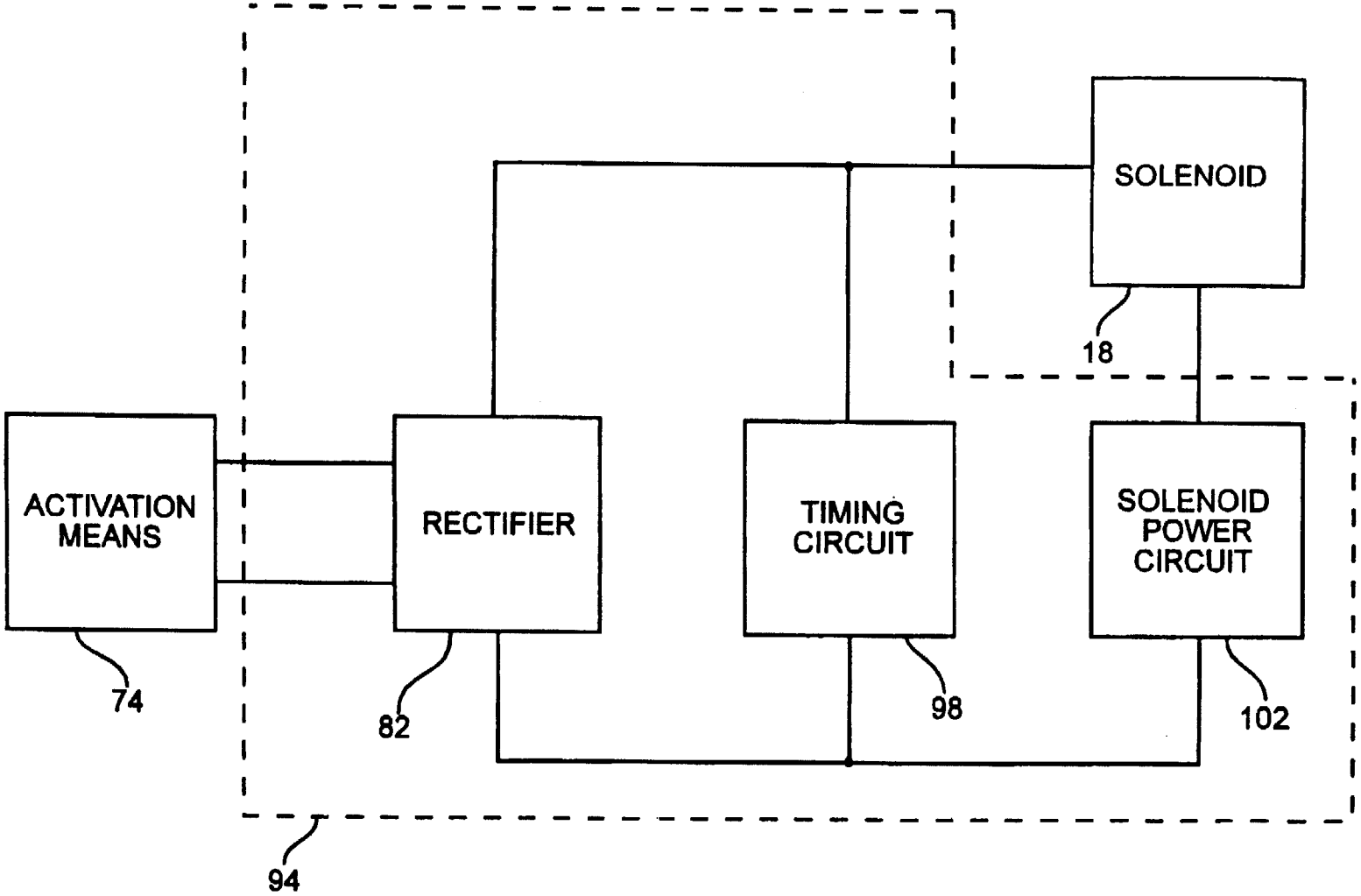
FIG. 8 is a block diagram of a second embodiment of a solenoid activation circuit in accordance with the present invention.
Figure 9:
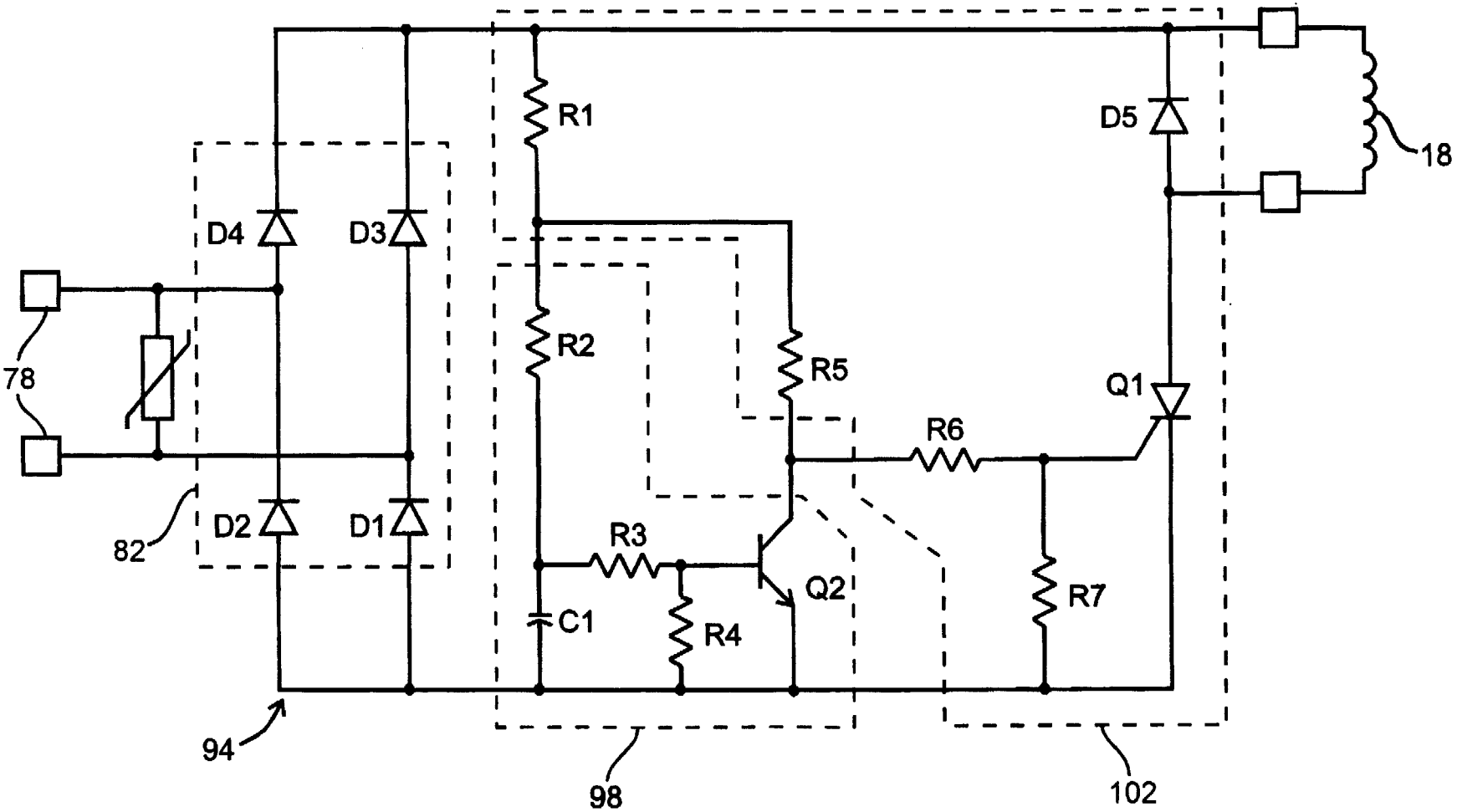
FIG. 9 is a circuit diagram of the second embodiment of a solenoid activation circuit in accordance with the present invention.

FIG. 8 is a block diagram of a second embodiment of a solenoid activation circuit generally indicated by reference numeral 94. In this embodiment the activation means 74 and rectifier 82 are comprised of the same elements as those in the first embodiment. As shown in FIG. 9, a timer circuit 98 is electrically connected to the outputs of rectifier 82 comprises resistors R2, R3 and R4, capacitor C1 and transistor Q2. A solenoid power circuit 102, including resistors R1, R5, R6 and R7, free wheeling diode D5 and a silicon controlled rectifier Q1, is also electrically connected to the outputs of the rectifier 82 and to the timer circuit 98. When an AC electrical activation signal is received from the activation means 74, current flows through resistors R1, R5, and R6 biasing the gate of Q1 such that Q1 goes into conduction, thereby causing current to flow through the solenoid 18. Current is also flowing through resistor R2, causing capacitor C1 to charge. As the charge on C1 increases, the base-bias voltage on Q2 also increases. When the base-bias voltage is sufficient, Q2 will conduct, causing current to flow through Q2, thereby decreasing the gate current of Q1 and causing Q1 to become ungated. Current will continue to flow through Q1 until the free wheeling current of solenoid 18 and free wheeling diode D5 has dropped to zero. The values of the timing circuit 98 components are chosen such that the time required for the base-bias voltage of Q2 to cause conduction of Q2 is sufficient for the solenoid 18 to perform its intended duty.

Figure 10:
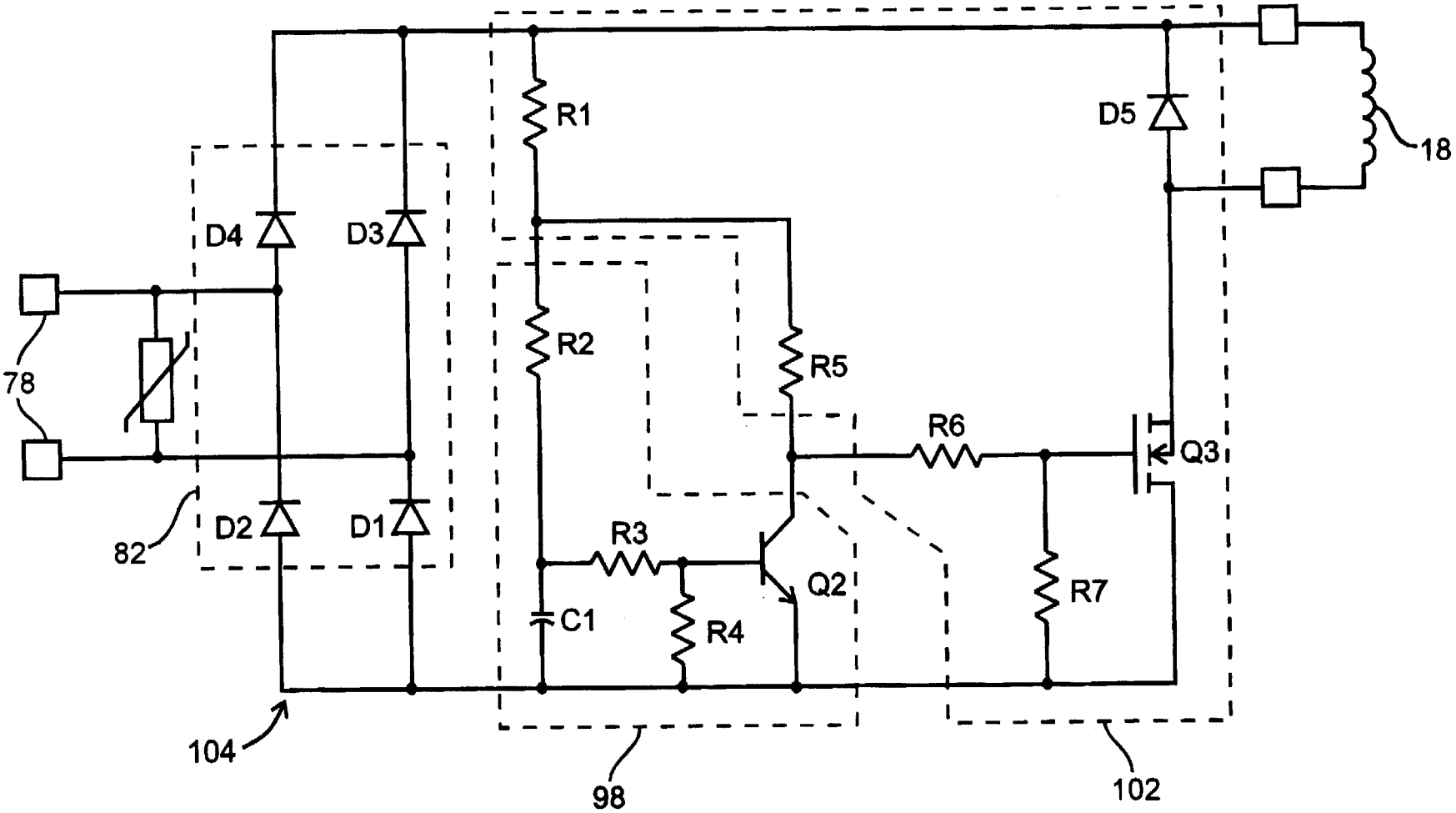
FIG. 10 is an alternate circuit diagram of the second embodiment of a solenoid activation circuit in accordance with the present invention.

An alternate solenoid activation circuit 104 is shown in FIG. 10. This embodiment is the same as shown in FIG. 9 except that an enhancement mode MOSFET Q3 replaces the SCR Q1 of FIG. 9. The MOSFET Q3 provides an immediate shutoff of power to the solenoid 18 when transistor Q2 starts conducting. The SCR of FIG. 9 will continue to conduct for a short time until free wheeling current has dropped to zero.

We claim:

1. A solenoid activation circuit providing protection against overheating of a small DC solenoid, said circuit comprising:

means for activating said solenoid activation circuit;

a rectifier for rectifying an alternating current signal received from said activating means, said rectifier having an input and an output;

a solenoid power circuit electrically connected between the solenoid and said input of said rectifier;

a timing circuit electrically connected between said solenoid power circuit and said output of said rectifier such that an active phase and a blocking phase are produced after each activation of said solenoid activation circuit.

2. The solenoid activation circuit of claim 1 wherein said solenoid power circuit comprises a pair of silicon controlled rectifiers which alternately provide power to the solenoid during alternating half cycles of an unrectifed alternating current at said input of said rectifier.

3. The solenoid activation circuit of claim 2 wherein said active phase is of a preselected length of time.

4. The solenoid activation circuit of claim 3 wherein said timing circuit determines said preselected length of time.

5. The solenoid activation circuit of claim 3 wherein said solenoid power circuit provides power to the solenoid during said active phase.

6. The solenoid activation circuit of claim 3 wherein said solenoid power circuit does not provide power to the solenoid during said blocking phase.

7. The solenoid activation circuit of claim 6 wherein during said blocking phase said timing circuit shunts power away from said solenoid power circuit.

8. The solenoid activation circuit of claim 1 wherein said means of activation is a manually operated operator interface device.

9. The solenoid activation circuit of claim 1 wherein said means of activation is a PLC.

10. The solenoid activation circuit of claim 1 wherein said solenoid activation circuit and the small DC solenoid are mounted on a printed circuit board.

* * * * *